United States Patent [19]

Bennett

[11] 4,015,753

[45] Apr. 5, 1977

[54] DIP TUBE POWDER SPRAY CONTROL DEVICE

[76] Inventor: Robert Bennett, 170 Sturbridge Road, Easton, Conn. 06425

[22] Filed: Mar. 17, 1976

[21] Appl. No.: 667,480

[52] U.S. Cl. ..... 222/193; 222/209; 239/327

[51] Int. Cl.[2] ..... B65D 83/06

[58] Field of Search ..... 239/318, 327, 328; 222/193, 207, 209, 215

[56] References Cited

UNITED STATES PATENTS

| | | | |
|---|---|---|---|
| 2,573,731 | 11/1951 | Ryberg et al. | 222/193 X |
| 2,631,064 | 3/1953 | Tupper | 222/193 X |
| 2,840,277 | 6/1958 | Back | 222/193 |
| 3,341,083 | 9/1967 | Stewart | 239/327 X |

FOREIGN PATENTS OR APPLICATIONS

| | | | |
|---|---|---|---|
| 1,028,802 | 5/1953 | France | 239/327 |
| 680,815 | 10/1952 | United Kingdom | 239/327 |

*Primary Examiner*—Robert B. Reeves
*Assistant Examiner*—David A. Scherbel

[57] ABSTRACT

A device which is inserted into an opening of a cap, the cap covering a container having powder. When the container or the portion thereof is depressed, a mixture of air and powder on a fine spray is dispensed. The device employs a first vertical hollow circular conduit having a first diameter, open at top and bottom ends and constituting a dip tube. A hollow spherical chamber having a second and much larger diameter and constituting an air powder mixing chamber is disposed above the dip tube, the top end of the dip tube being connected to the bottom of the chamber. A second vertical hollow conduit having a third diameter smaller than the first diameter is secured at its open bottom end to the top of the chamber and is used to discharge the mixture from its top open end. A third vertical hollow conduit open at top and bottom ends and having a diameter substantially the same as the third diameter is disposed along the first conduit and constitutes an air tube. The bottom end of the third conduit is disposed above the bottom end of the first conduit and the top end is disposed below the chamber. A fourth inclined hollow conduit having a diameter substantially equal to the third diameter interconnects the third conduit to the chamber to supply air thereto.

6 Claims, 6 Drawing Figures

DIP TUBE POWDER SPRAY CONTROL DEVICE

BACKGROUND OF THE INVENTION

Dispensers of air powder mixtures are of two known types: those of aerosol type and those employing manually operable pumps. Aerosol type dispensers are now considered hazardous and the dispensers using manually operable pumps are expensive and tend to plug up with powder when operated quickly and repeatedly.

This invention overcomes these problems by means of a device which does not employ aerosols, is far less expensive than pump type dispensers and will not plug up with powder no matter how quickly or repetitively operated.

SUMMARY OF THE INVENTION

In accordance with the principles of the invention powder is forced upward along a vertical dip tube while air is simultaneously faced upward along a vertical air tube disposed alongside the dip tube. The powder is discharged from the dip tube vertically upward into a spherical mixing chamber. At the same time the air is discharged from the air tube into the chamber, the air entering the chamber along an upwardly inclined path. The resulting swirling action of air and powder within the chamber produces an essentially homogenous mixture of air and powder which is discharged vertically upwardly through a vertical discharge tube connected at its bottom end to the chamber as fine spray.

DETAILED DESCRIPTION OF PREFERRED EMBODIMENT

Figure 1:
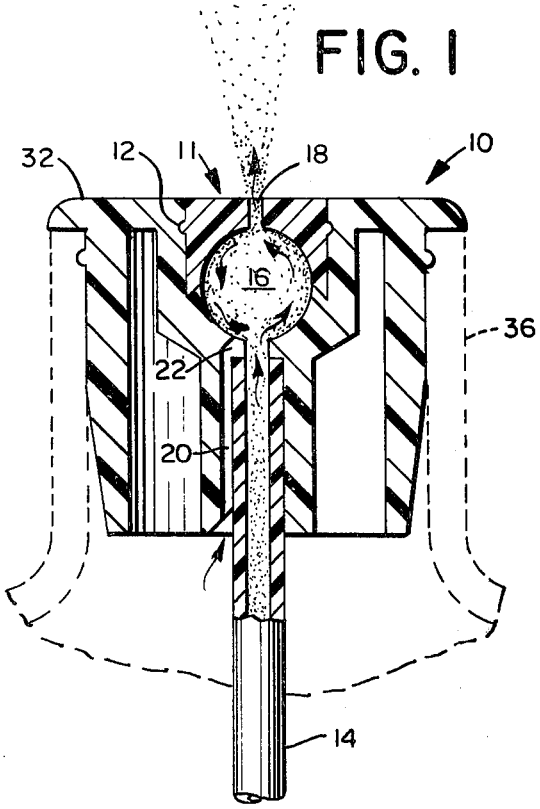
FIG. 1 is a cut away side view of a member containing the various conduits and chamber.
Figure 4:
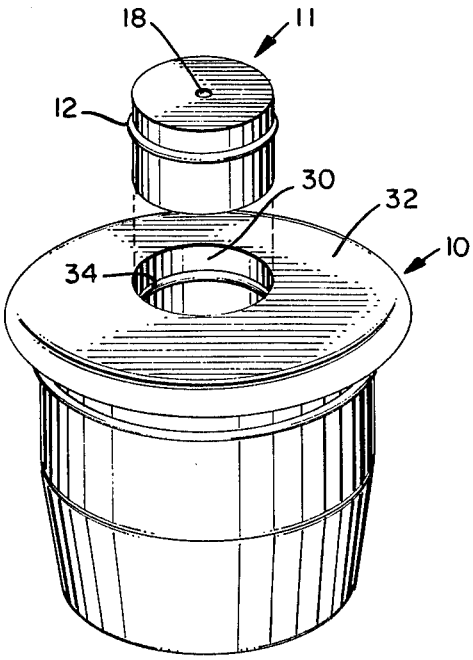
FIG. 4 is partially exploded view of a container incorporating the member of FIGS. 1–3.
Figure 2:
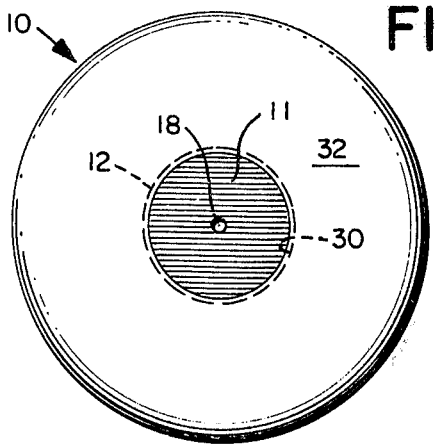
FIG. 2 is a top view of the structure of FIG. 1.
Figure 3:
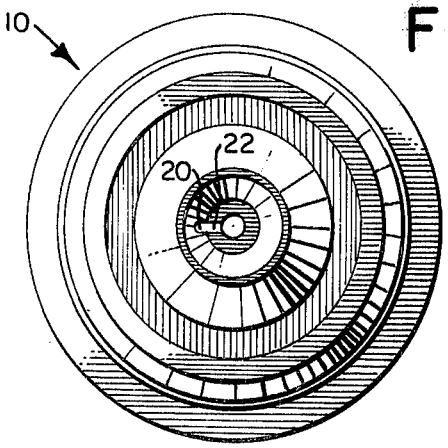
FIG. 3 is a bottom view of the structure of FIG. 1 with dip tube removed.

Referring first to FIGS. 1–3, a polypropelene member forms a generally cylindrical structure 11 with a horizontally disposed exterior rib 12. The member contains spherical chamber 16. A vertically elongated dip tube 14 which constitutes a first hollow conduit open at top and bottom ends with a typical diameter of 0.032 inches. The top of tube 14 communicates with the bottom of chamber 16. The inner diameter of this chamber is typically 0.187 inches. A short vertical discharge port 18 which constitutes a second hollow conduit communicates at its open bottom end with the top of chamber 16 and is open at its top end which serves a discharge port. The diameter of port 18 is typically 0.020 inches. The length of port 18 is typically 0.030 inches. A vertical air slot 20 which constitutes a third hollow conduit extends therealong, being open at a bottom end which is disposed above the bottom end of tube 14 and being open at a top end which is disposed below the top end of tube 14. Typically the diameter of slot 20 is 0.020 inches. A vertically inclined air feed slot 22 which constitutes a fourth hollow conduit typically oriented at an angle of 45° as viewed in the vertical plane connects the top end of tube 20 to the interior of chamber 16. Tube 22 is very short, being approximately 0.030 to 0.050 inches long.

The structure 11 is snap fitted into the central bore 30. The cap 10 is fitted over the open end of container 36 which can be almost entirely filled with a fine powder such as talcum powder or the like. The bottom end of the dip tube 14 extends into the powder to a point just above the bottom of the container. The bottom end of the air slot 20 is disposed above the powder adjacent the top of the container.

Container 36 is flexible and when squeezed produces a blowing action which draws powder grains up tube 14 and simultaneously blows air up through the tube 20. The whirling mixing action of air and powder in the chamber produces an essentially homogeneous mixture which is discharged as a fine spray via the discharge port 18.

The effectiveness of the whirling action depends upon the ratio of air and powder and also upon the angle of the air feed tube. The angle is optimum at about 45°. The ratio powder to air is normally proportional to the ratio of the cross sectional area of tube 14 to the cross sectional area of port 18. This ratio is defined by the ratio of the squares of the respective diameters of these tubes and is optimum at about 0.6 to 0.2. In the arrangement shown when pressure on the container is released, the suction force is strong enough to cause tube 14 to be fully cleared of powder after each spray whereby clogging cannot occur. When the diameter of tube 14 is decreased much below 0.032 inches the increase in friction resistance to flow will cause the tube to clog to some extent while an increase in this diameter will cause a reduction in suction force which also can cause clogging. The diameter of slot 20 is substantially equal to that of part 18. If the diameter of slot 20 is increased much in excess of that of part 18, the spray loses uniformity and if decreased much below that of part 18, the discharge port can clog.

Figure 5:
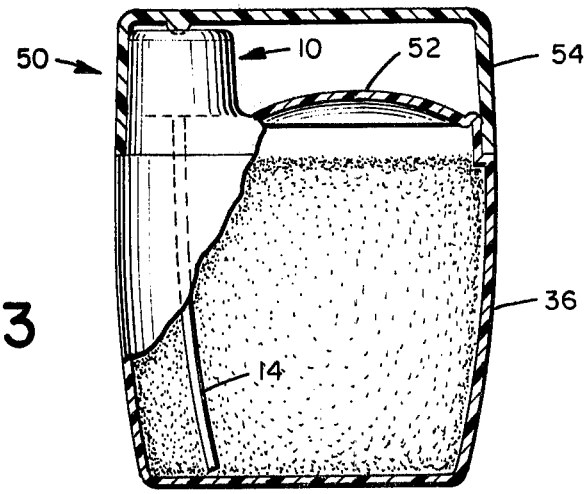
FIG. 5 is a partially cut away side view of a modified container which also incorporated the member of FIGS. 1–3.
Figure 6:
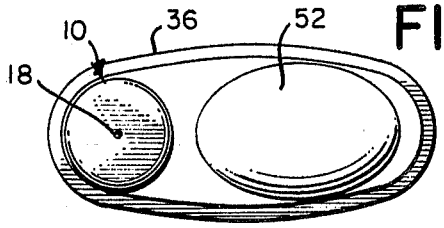
FIG. 6 is a top view of the container of FIG. 5 with the top cover removed.

In the arrangement of FIGS. 5 and 6, the structure 10 is mounted on top of an orifice disposed off center in container 50. A normally convex finger depressable flexible bulge or popper 52 forms a portion of the top of the container and when depressed and released always developes the same suctional force whereby a metered amount of spray is produced for each individual action. A removable cover 54 completes the structure.

The spray will function as described whether the container is held upright or inverted or in any intermediate position.

While the invention has been described with particular reference to the drawings, the protection sought is to be limited only by the terms of the claims that follow.

I claim:

1. A device comprising:

a first vertical hollow conduit open at top and bottom ends, said conduit having a circular cross section with a first diameter;

a hollow spherical chamber having a second diameter substantially larger than the first diameter and disposed above the first conduit; the top end of the first conduit being connected to and communicating with the bottom of the chamber;

a second vertical hollow conduit disposed above the chamber, said second conduit having a circular cross section with a third diameter smaller than said first diameter and open at top and bottom ends, the bottom end of the second conduit being connected to and communicating with the top of the chamber, the top end of the second conduit constituting a discharge port;

a third vertical hollow conduit open at top and bottom ends and disposed alongside of the first conduit, the third conduit having a circular cross section, the diameter of the third conduit being substantially equal to the third diameter, said third conduit having an open bottom and disposed above the bottom end of the first conduit and having an open top end disposed below the top end of the first conduit; and a fourth inclined hollow conduit open at both ends, the top end of the third conduit being connected to the lower end of the fourth conduit, the upper end of the fourth conduit being connected to said chamber and communicating therewith, said fourth conduit having a circular cross section, the diameter of the fourth conduit having a circular cross section, the diameter of the fourth conduit being substantially equal to said third diameter.

2. The device of claim 1 wherein the vertical angle of inclination of the fourth conduit is approximately 45°.

3. The device of claim 2 wherein the diameters as expressed in thousands of an inch are approximately as follows:

First diameter; 0.032;
Second diameter; 0.187;
Third diameter; 0.020.

4. The device of claim 1 further including a cap which partially defines said chamber and said first conduit.

5. The device of claim 4 further including a cylindrical structure which together with said cap completely defines said chamber.

6. The device of claim 1 further including a hollow container having an open top closed by said cap, said container being partially filled with powder, the bottom end of the first conduit extending into the powder, the bottom end of the third conduit being disposed above the level of the powder.

* * * * *